United States Patent [19]

Takabayashi

[11] Patent Number: 4,608,905

[45] Date of Patent: Sep. 2, 1986

[54] TREMOLO APPARATUS FOR AN ELECTRIC GUITAR WITH TUNING FUNCTION

[75] Inventor: Youjiro Takabayashi, Hamamatsu, Japan

[73] Assignee: Nippon Gakki Co., Ltd., Shizuoka, Japan

[21] Appl. No.: 701,122

[22] Filed: Feb. 13, 1985

[30] Foreign Application Priority Data

Feb. 25, 1984 [JP] Japan ..... 59-25244[U]

[51] Int. Cl.[4] ..... G10D 3/00

[52] U.S. Cl. ..... 84/313; 84/297 R; 84/298; 84/312 R

[58] Field of Search ..... 84/297 R, 298, 299, 84/313, 312 R

[56] References Cited

U.S. PATENT DOCUMENTS 3,407,696 10/1968 Smith et al. ..... 84/297 R
4,171,661 10/1979 Rose ..... 84/313

FOREIGN PATENT DOCUMENTS 2116768 9/1983 United Kingdom .
2133197 7/1984 United Kingdom ..... 84/313

*Primary Examiner*—Benjamin R. Fuller

*Attorney, Agent, or Firm*—Koda and Androlia

[57] ABSTRACT

A tremolo apparatus with tuning function for an electric guitar including a bridge base disposed on a body of the guitar in such a manner as to freely tilt vertically, a plural number of octave tuning members disposed on the bridge base corresponding to respective strings and movable in a stretching direction of the strings for effecting octave tuning, a plural number of octave tuning screws which independently move and adjust respective octave tuning members in a stretching direction of the strings, a plural number of string holding members disposed respectively in the octave tuning members in such a manner as to freely move in the stretching direction of the strings for holding one end of each string, a plural number of tensile force control mechanisms serving to independently move and adjust respective string holding members in a stretching direction of the strings, and a balance spring providing the bridge base with a balancing movement acting in the direction opposite to the direction of the movement given by the tensile forces of the strings. The tensile force control mechanism may be operated by means of a nut member provided horizontally to the guitar body or perpendicularly to the same.

10 Claims, 6 Drawing Figures

FIG. 1
PRIOR ART
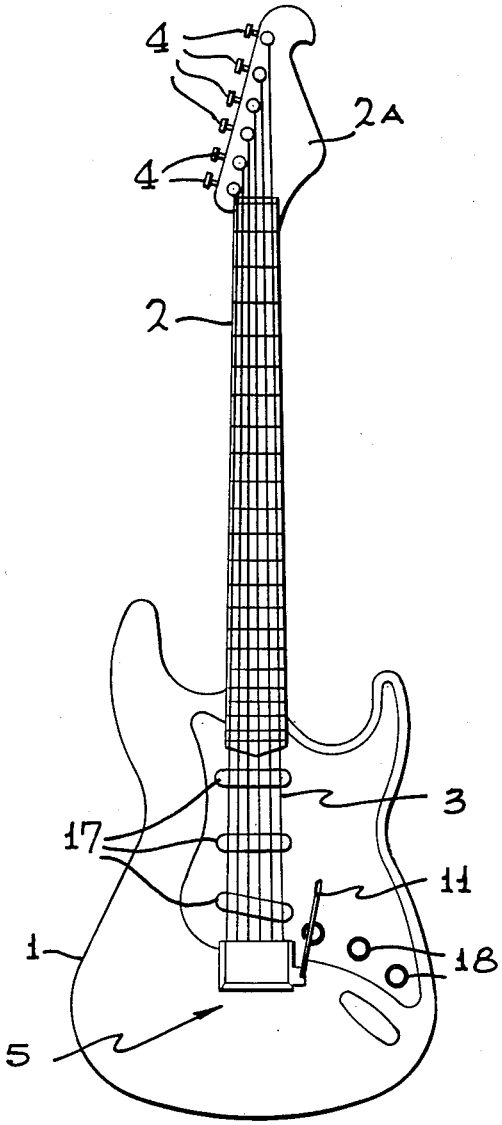
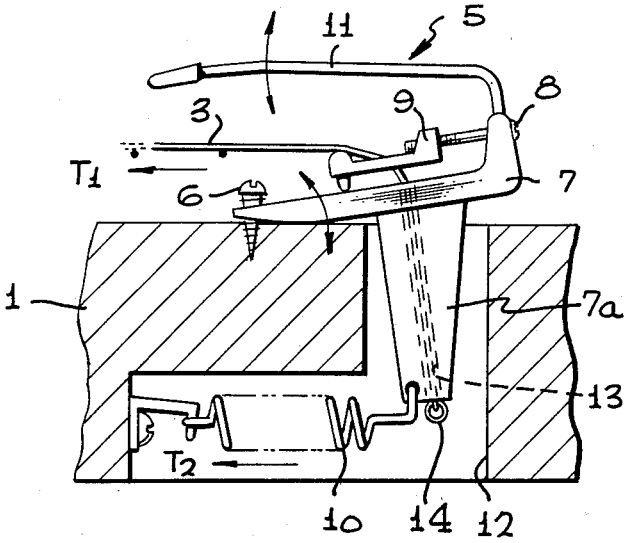
FIG. 2
PRIOR ART
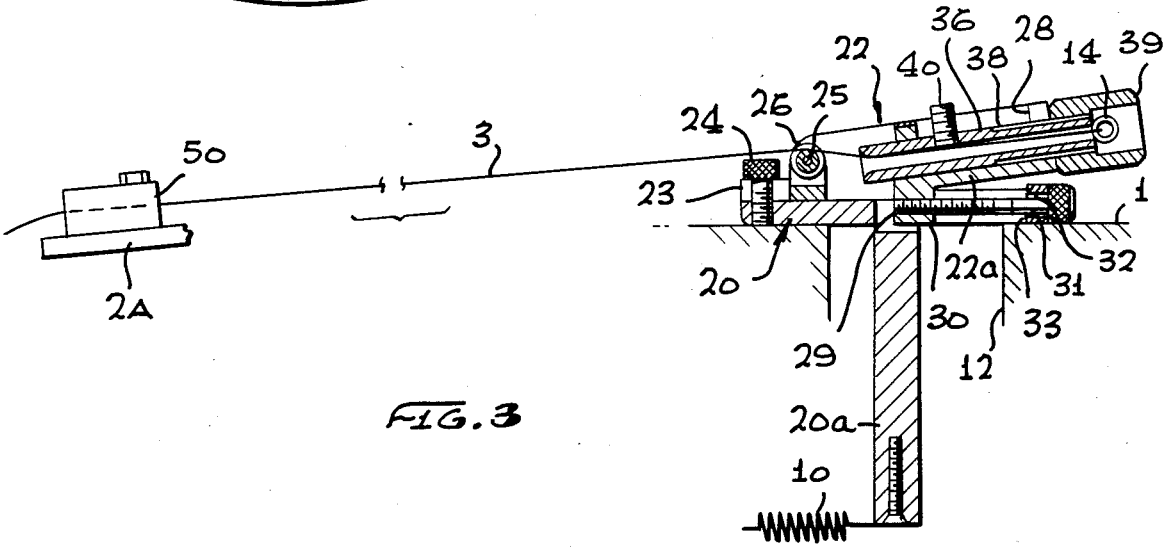
FIG. 3

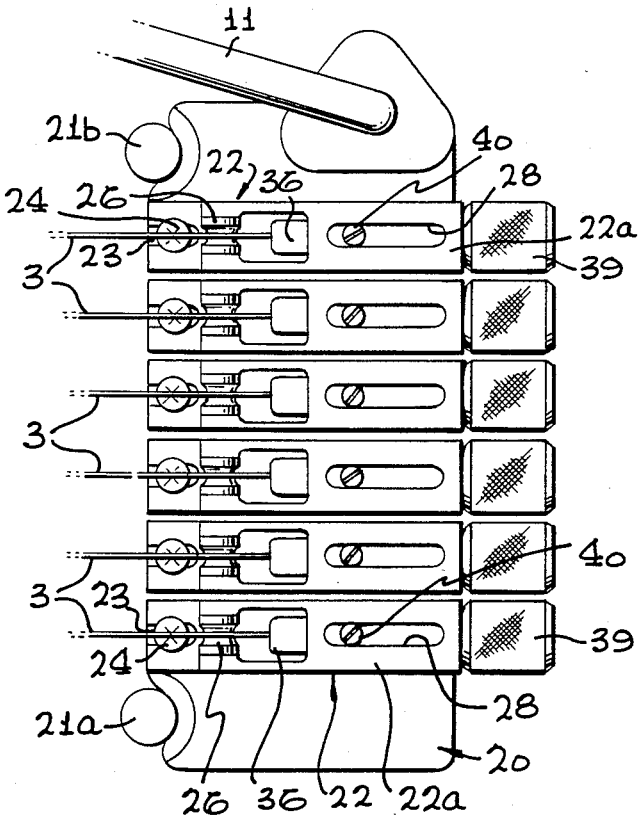
FIG. 4
FIG. 5
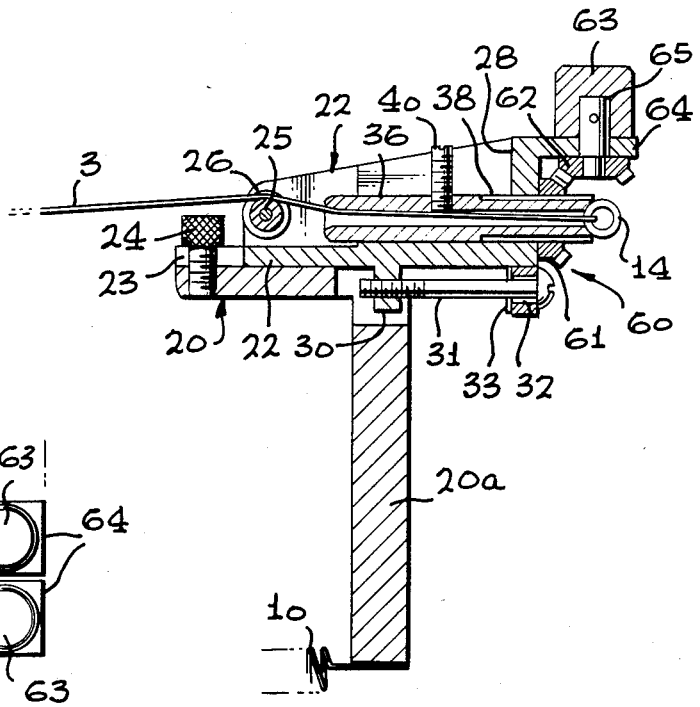
FIG. 6
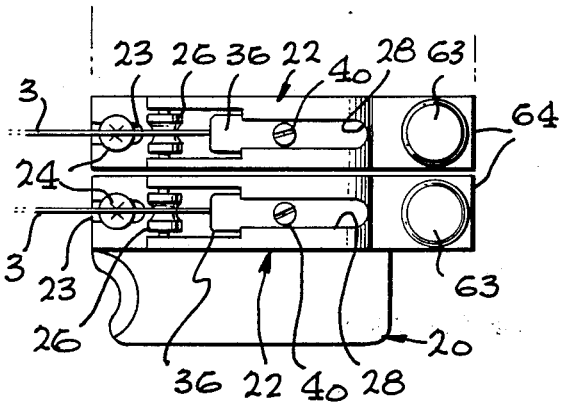

TREMOLO APPARATUS FOR AN ELECTRIC GUITAR WITH TUNING FUNCTION

BACKGROUND OF THE INVENTION

1. Field of the Invention

This invention relates to a tremolo apparatus for an electric guitar, and particularly to a tremolo apparatus for an electric guitar equipped also with a tuning function.

2. Prior Art

It is generally known that when the tension of a string is lowered, the vibration frequency of the string is lowered, while on the contrary, when a string is tightened, vibration frequency of the string is increased. Accordingly, in an electric guitar, by causing a variation in string tension with quick repetitive cycles, the pitch (musical interval) is varied to high and low in order to obtain a specific sound effect; this is known as the so-called "tremolo effect."

A brief description will be given below of the structure of a solid type electric guitar having a conventional tremolo unit mechanism, with reference to FIGS. 1 and 2. In this electric guitar, reference numeral 1 denotes the body and reference numeral 2 denotes the neck. Over the body 1 and neck 2 a set of string 3 composed of, for example, six strings are disposed in a stretched form. One end of each of the strings 3 is held by a tuning peg 4 disposed at the head portion 2A of the neck 2 in such a manner that the strings 3 can be either tightened or loosened. The other ends of the respective strings 3 are held by a tremolo unit 5 provided on the body 1.

The above-mentioned tremolo unit 5 includes a bridge base 7, a plural number of bridge bodies 9, a balance spring 10, a tremolo arm 11, etc. The bridge base 7 is disposed on the body 1 in such a manner to be rotatable freely in a vertical direction by using a set screw 6 as the rotational fulcrum. The bridge bodies 9 are disposed on the bridge base 7 and correspond with the respective strings 3. Each of the bridge bodies 9 can be adjusted independently by an octave setting screw 8 by being moved in a longitudinal direction of the string 3. The balance spring 10 urges the bridge base 7 to turn clockwise in the FIG. 2. The tremolo arm 11 is used for moving the bridge base 7 up and down.

For stretching the strings 3, one end of the respective strings 3 are inserted from below into a through hole 13 of a spring anchoring portion **7*a* that is formed under the bridge base 7 so as to protrude from the underside of the bridge base 7. This spring anchoring portion 7*a* is positioned within a spring housing room 12 of the body 1 by being inserted into the same. The strings 3 inserted into the foregoing through hole 13 are then stretched along the upper surfaces of the corresponding bridge bodies 9. Thereafter, the strings 3 are anchored to and held by the tuning pegs 4, and a ball end portion 14 attached to the other end of the string 3 is anchored to the underside of the spring anchoring portion 7*a***.

After this operation, each string 3 is tuned to a specified pitch through adjustment effected by rotating the tuning peg 4. In this case, movement of the tremolo unit 5 in a counterclockwise direction by the sum total of the tensile force $T_1$ of the strings 3 which are stretched to specified pitches is designed to be balanced at a certain point with the tensile force $T_2$ due to the spring force of the balance spring 10, so that the bridge base 7 is held at an angle and position whereby the bridge base 7 is maintained in a state somewhat lifted from the body 1 as shown in the FIG. 2. In this state, when the tremolo arm 11 is moved vertically, the balanced state is put out of balance and the tension in each of the strings 3 is varied. As a result, the tremolo effect is obtained.

In the FIG. 1, reference numeral 17 indicates pick-up devices, and reference numerals 18 are the knobs for controlling sound volume and sound quality.

In such conventional tremolo unit mechanisms, however, the strings 3 must be inserted into the through hole 13 from the underside of the body 1 and then have to be led to the top surface of the bridge bodies 9. Therefore, the installation of the strings is troublesome posing a problem in handling.

Furthermore, conventional tremolo unit mechanisms, as mentioned above, have the following inconveniences: loosening of the strings 3 caused at the tuning pegs 4 and the pitches become deranged during operation of the tremolo mechanism.

In light of such problems, as shown in U.S. Pat. No. 4,171,661, a device to lock up the strings with a nut unit in order to prevent detune in pitch was provided. However, when using device provided by U.S. Pat. No. 4,171,661, once the string is locked by the nut unit, when the adjustment of the pitch becomes necessary thereafter, the lock must be released to adjust the pitch with the tuning peg, then the locking must be done again, thereby lowering operational efficiency.

As a result, a represented by UK Patent Application No. GB 2116 768 A, tremolo which are equipped with a fine tuning mechanism for pitch have been provided. In this device, the variable tuning range (a movable distance of the string in its stretching direction) is about 2 mm.

SUMMARY OF THE INVENTION

The present invention was achieved by further developing the foregoing concept in view of the aforementioned background of this invention. That is, by noting that the tuning peg is no longer operational once the string is locked by the nut unit, it was decided to incorporate the function of the tuning peg into the function of the member functioning to fine tune the pitch. In other words, for the neck only a member for fixing the strings is provided while for the bridge portion, it is designed such that the functioning ranges of its members which serve to finely tune the string pitch are expanded. In this way, the provision of the tuning pegs is not necessary.

In addition, it is the aim, at the same time to eliminate difficulty in obtaining good weight balance for the guitar caused by the weight of the head portion becoming heavy because of the requirement of providing the tuning pegs there.

It is therefore an object of the present invention to provide a tremolo unit mechanism for an electric guitar with a tuning function that facilitates the installation of the strings.

It is another object of the present invention to provide a tremolo unit mechanism for an electric guitar with a tuning function that is improved in operational efficiency during tuning.

It is further an object of the present invention to provide a tremolo unit mechanism for an electric guitar with a tuning function that makes it easy to set up the weight balance of the guitar.

The characteristic features of the tremolo unit mechanism for an electric guitar, whereupon the above-mentioned objects of the present invention were achieved, are as described below. That is, octave tuning members are disposed on the bridge base in such a manner that those octave tuning members are allowed to move freely in the stretching direction of the strings in order to effect tuning. The foregoing octave tuning members are each provided with a string holding member that is disposed in a manner to be allowed to move freely in the stretching direction of the string. One end of each string is held by this string holding member. Then, the string holding member is moved for effecting tuning by means of the tensile force adjusting mechanism.

BRIEF DESCRIPTION OF THE DRAWINGS

FIG. 1 is a top plan view of an electric guitar having a conventional tremolo unit mechanism;

FIG. 2 is a sectional view of a conventional tremolo unit mechanism;

FIGS. 3 and 4 are a sectional view and a plan view, respectively, showing an embodiment according to this invention; and FIGS. 5 and 6 are a sectional view and a plan view, respectively, of the essential portion of the other embodiment in accordance with this invention.

DETAILED DESCRIPTION OF THE INVENTION

FIG. 3 is a sectional view showing an embodiment according to this invention, and FIG. 4 is a plan view thereof. In these Figures, the structural members which are the same as those in FIG. 1 and FIG. 2 are marked with the same reference numbers and the description of them is omitted to reduce repetition. In these figures, that represented by 20 is a bridge base formed into T-shape in its sectional view. This bridge base has a tremolo arm 11, and it is disposed on a body 1. By being held by contacting a pair of columns 21*a* and 21*b* located on the left and right sides, respectively, this bridge base 20 is kept from moving toward the head portion 2A. An extended portion 20*a* formed as an integral part of the bridge base 20 projecting from the underside of the bridge base 20 is inserted and positioned in a spring housing room 12 of the body 1. To the lower end of this extend portion 20*a* of the bridge base 20, one end of a balance spring 10 is anchored. This balance spring 10 provides the bridge base 20 with a moment for clockwise turning, according to FIG. 3, with the foregoing columns 21*a* and 21*b* as the rotational fulcra.

Over the aforementioned bridge base 20 a plural number (six, for example) of octave tuning members 22 are disposed by corresponding each to each of string 3. Each of these octave tuning members has a long hole or slot 23 formed at its front end surface. By means of this slot 23, the octave tuning member 22 is fixed to the bridge base 20 in such a manner as to be movable in the stretching direction of the string 3 in order to effect the octave tuning and is fastened by a set screw 24 that is screwed into the bridge base 20 through the slot 23. Also, at the front end portion of each of these octave tuning members 22, a roller 26 is disposed by means of a shaft 25, and onto this roller 26, each corresponding string 3 is pressed from above and comes into contact with it.

On the other hand, the rear half of each of the octave tuning member 22 is formed into cylindrical shape, and into this cylindrical portion 22*a*, a string holding member 36 (which will be described later) for holding one end of the string 3 is fitted in such a manner as to be allowed to move freely in the axial direction, that is, in the stretching direction of the string 3. Over the upper surface of the cylindrical portion 22*a*, a long hole or slot 28 is formed along the axial direction, while at the underside of the cylindrical portion 22, a screw fitting portion 30 whereto an octave tuning screw 31 is screwed in is formed in such a manner as to protrude from the underside of the cylindrical portion 22*a*, as an integral part thereof. The foregoing octave tuning screw 31 is inserted into an insertion hole 32 opened at the rear end of the bridge base 20. This octave tuning screw 31 is restricted in its movement in the axial direction, by an E ring 33. The end portion of the octave tuning screw 31 is screwed into a tapped hole 29 in the screw fitting portion 30. Therefore, when the octave tuning screw 31 is rotated after loosening the set screw 24 first, the octave tuning member 22 moves back and forth. As a result, the supporting point for the string 3, that is provided by the roller 26, is shifted. As a result, the length of the string 3 for vibration is varied.

The string holding member 36 is formed into cylindrical shape with its both ends open, and inside of this string holding member 36 the string 3 is inserted. A ball end portion 14 attached to one end of the string 3 is anchored to the rear end opening of the string holding member 36. Over the outer circumferential surface of the rear end portion of the string holding member 36, a male screw portion 38 is formed, and a nut 39 as a tensile force control mechanism is constantly pressed and kept in contact with the rear end surface of the cylindrical portion 22*a*, due to the tensile force of the string 3. Also, to the outer circumferential surface of the string holding member 36, a machine screw 40 is screwed in through the slot 28 of the cylindrical portion 22*a* and by means of this machine screw 40 the string holding member 36 is prevented from being rotated. Accordingly, when the nut 39 is rotated, the string holding member 36 is moved back and forth within the range of the slot 28, thereby causing the tensile force of the string 3 to vary.

On the upper surface of the head portion 2A, a head block 50 for holding the other ends of the strings 3 is jointly fixed. Through the provision of this block 50, the conventional tuning pegs as shown in FIG. 1 are eliminated. The head block 50 functions only to hold the respective strings 3, without having the tensile force controlling function, and the tuning is effected solely by the nut 39. Therefore, according to the experience of the inventor, it is necessary for the string holding member 36 to be provided with at least 10 mm as the movable range in the direction along the length of the string 3.

As should be apparent from the description given above, the tremolo unit mechanism according to the foregoing embodiment of this invention is simple in its structure. Also, the installation of the string 3 requires only the insertion of the string 3 into the nut 39 and the string holding member 36, both provided on the top surface of the body 1. Consequently, it is not necessary to turn over the body 1 and thus, the installation of the string 3 is made simple. Also, the tuning operation for the string 3 can be facilitated as it is performed by merely moving the string holding member 36 back and forth by rotating the nut 39.

In addition, through the use of the head block 50 to hold the other ends of the strings 3, the tuning pegs become unnecessary and the number of parts can be cut down. Furthermore, the weight balance of the guitar when playing the guitar in a standing posture can be improved.

Referring to FIG. 5 and FIG. 6, shown therein are a sectional view and a plan view of the essential portion which shows another embodiment obtained by further developing the concept of this invention to more facilitate the operation of an electric guitar and tremolo unit mechanism with the tuning function provided by this invention. This embodiment is similar in its structure to that of the preceding embodiment except that the tensile force control mechanism 60 is constructed of a pair of bevel gears 61 and 62 and an operation knob of lug 63. Of the pair of bevel gears 61 and 62 described above, one bevel gear 61 is screwed onto the male screw portion 38 of the string holding member 36. The other bevel gear 62 as a counterpart is fit and fixed to the lower end of a feely rotatable shaft 65 that is provided on an extended portion 64 protruding from the rear end of the octave tuning member 22. This bevel gear 62 is engaged with the other bevel gear 61. The upper portion of the shaft 65 is fixed to the operation knob 63.

In this state of engagement, the bevel gear 61 is blocked and prevented from moving in the axial direction, by being kept in close contact with the rear surface of the octave tuning member 22, and thus maintains a secure engagement with the counterpart bevel gear 62. With this arrangement, when the operation knob 63 provided over the upper end portion of the shaft 65 is rotated by manual operation and its rotation is transmitted to the bevel gear 61 by way of the shaft 65 and the other bevel gear 62, the string holding member 36 that is screwed into this bevel gear 61 is caused to move back and forth, thereby in turn causing the string 3 to vary its tensile force.

It is apparent that even with such structure, the same effects as shown in the previously mentioned embodiment can be obtained. In addition, because the operation knob 63 is positioned perpendicularly to the body 1, it is particularly excellent in operability for playing the guitar in a standing posture.

As has been described above, the tremolo unit mechanism for an electric guitar provided by the present invention is constructed as follows. That is, the octave tuning members are disposed on the bridge base, in a manner that these octave tuning members can be moved freely along the stretching direction of the strings, for effecting the octave tuning. In each of these octave tuning members, each of the string holding members is disposed in a manner to be freely movable in the stretching direction of the strings. By these strings holding members, one end of each of the strings is held. Then, the string holding members are moved and controlled by the tensile force control mechanisms, for effecting the tuning. Therefore, the installation of the strings can be done on the top surface side of the body with simple handling. Also, the tuning operation can be performed easily. As a result, the operability of a musical instrument can be improved. In addition, since the tuning pegs are unnecessary, the freedom in setting the weight balance of the guitar can be increased.

I claim:

1. A tremolo apparatus with tuning function for a guitar having a body and a neck, said tremolo apparatus comprising:

a bridge base installed to the body in such a manner as to be tiltable upward and downward freely;

a plural number of octave tuning members provided on the bridge base with each of them corresponding to each of the strings, respectively, and in such a manner as to be movable in the stretching direction of the string for performing octave tuning;

a plural number of octave tuning screws which function to move and adjust the respective octave tuning members independently to each other in the stretching direction of the string;

a plural number of string holding members each of which is disposed in each of the octave tuning members in such a manner as to be movable in the stretching direction of the string, while holding one end of each of the strings;

a plural number of tensile force control mechanisms which serve to move and control the respective string holding members independently of each other in the stretching direction of the string; and a balance spring for providing said bridge base with the balancing moment that works in a direction opposite to a direction along which a moment to tensile forces of the string works.

2. A tremolo apparatus as set forth in claim 1, wherein each of the tensile force control mechanisms is provided with a least 10 mm of movement as its control range for freely moving the string holding member in the stretching direction of the string.

3. A tremolo apparatus with tuning function as set forth in claim 2, wherein each of the said tensile force control mechanisms is characterized in that:

each of the respectively corresponding octave tuning members has a cylindrically shaped portion whereto each of the string holding members that corresponds to the cylindrically shaped portion is inserted; and each of the tensile force control mechanisms is equipped with a means to shift and adjust the position of the string holding member relative to that of the octave tuning member.

4. A tremolo apparatus with tuning function as set forth in claim 3, wherein said string holding member has a through hole formed inside in order to insert each string, and to the opening at the rear end of the through hole, a ball formed at one end of the string is anchored so that the string is held by the string holding member.

5. A tremolo apparatus with tuning function as set forth in claim 3, wherein said means for shifting the relative position of the string holding member with respect to the position of the octave tuning member comprises:

a male screw portion formed over a circumferential surface of a rear portion of the string holding member; and a nut member having a female screw portion screwed onto the male screw portion which is anchored to a rear portion of the octave tuning member;

whereby the tensile force of the string is controlled by operating said nut member.

6. A tremolo apparatus with tuning function as set forth in claim 3, wherein said means for shifting the relative position of the string holding member with respect to the position of the octave tuning member comprises:

a male screw portion formed over a circumferential surface of a rear portion of the string holding member;

a first bevel gear provided with a female screw portion that is formed along the inner circumferential surface in order to be screwed onto said male screw portion;

a second bevel gear engaged with said first bevel gear as its counterpart; and an operation knob that is fixed onto a shaft disposed in a direction perpendicular to a plane of the body so that said operation knob sticks up over said octave tuning member, and is rotated for effecting the adjustment of the tensile force of the string for tuning.

7. A tremolo apparatus with tuning function as set forth in claim 2, wherein said octave tuning screw is held by the bridge base in a freely rotatable manner with its end portion screwed into a tapped hole formed in the octave tuning member.

8. A tremolo apparatus for an electric guitar with tuning function as set forth in claim 2, wherein each of said octave tuning members has a slot through which a set screw is screwed into said bridge base, and said each octave tuning member which is movable in the stretching direction of the string is guided by said set screw in its movement, and after octave tuning is done, the octave tuning member is fixed to the bridge base by said set screw.

9. A tremolo apparatus with tuning function as set forth in claim 2, wherein each of said octave tuning members has a roller that is disposed by means of a shaft provided on said octave tuning members in such a manner to be rotatable relative to said shaft, each string pressing from above to come into contact with said roller.

10. A tremolo apparatus with tuning function as set forth in claim 3, wherein a slot is formed over the cylindrical portion of said octave tuning member, and through said slot, a machine screw is fixed to the string holding member disposed in said cylindrical portion to prevent said string holding member from rotating relative to said octave tuning member.

* * * * *